US009719708B2

(12) United States Patent
Okano et al.

(10) Patent No.: US 9,719,708 B2
(45) Date of Patent: Aug. 1, 2017

(54) AIR-CONDITIONING APPARATUS WITH SIMULTANEOUS HEATING AND COOLING OPERATION

(75) Inventors: Hiroyuki Okano, Tokyo (JP); Hirofumi Koge, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 302 days.

(21) Appl. No.: 14/390,428

(22) PCT Filed: May 30, 2012

(86) PCT No.: PCT/JP2012/003515

§ 371 (c)(1),
(2), (4) Date: Oct. 3, 2014

(87) PCT Pub. No.: WO2013/179334

PCT Pub. Date: Dec. 5, 2013

(65) Prior Publication Data

US 2015/0176879 A1 Jun. 25, 2015

(51) Int. Cl.

| | |
|---|---|
| ***F25B 13/00*** | (2006.01) |
| ***F25B 49/02*** | (2006.01) |
| ***F25B 30/02*** | (2006.01) |
| ***F25B 41/04*** | (2006.01) |
| *F24F 11/00* | (2006.01) |

(52) U.S. Cl.

CPC ..... *F25B 49/02* (2013.01); *F25B 13/00* (2013.01); *F25B 30/02* (2013.01); *F25B 41/043* (2013.01); *F24F 2011/0089* (2013.01); *F24F 2221/54* (2013.01); *F25B 2313/006* (2013.01); *F25B 2313/0231* (2013.01); *F25B 2313/0233* (2013.01); *F25B 2313/0272* (2013.01); *F25B 2313/0292* (2013.01); *F25B 2313/02741* (2013.01); *F25B 2600/2513* (2013.01)

(58) Field of Classification Search

CPC ..... F25B 41/043; F25B 2313/006; F25B 2313/0231; F25B 2313/0233; F24F 2221/54

See application file for complete search history.

(56) References Cited

U.S. PATENT DOCUMENTS 5,040,376 A * 8/1991 Ueno ..... F25B 13/00 165/205
5,050,396 A * 9/1991 Ohkoshi ..... F24F 11/0009 237/2 B (Continued)

FOREIGN PATENT DOCUMENTS

JP 02-223757 A 9/1990
JP 04-073559 A 3/1992

(Continued)

OTHER PUBLICATIONS

JP 05-215437 (English Translation).*

(Continued)

*Primary Examiner* — Jonathan Bradford
(74) *Attorney, Agent, or Firm* — Posz Law Group, PLC

(57) ABSTRACT

In a heating main operation mode in which a load to be processed by the heating operation is dominant during cooling and heating mixed operation, an air-conditioning apparatus closes an opening and closing valve, and adjust the opening degree of an expansion device in accordance with the evaporating temperature of a load-side unit requesting cooling.

6 Claims, 6 Drawing Sheets

(56) References Cited

U.S. PATENT DOCUMENTS

| | | | | |
|---|---|---|---|---|
| 5,107,684 | A * | 4/1992 | Nakayama | F24F 3/065 62/160 |
| 5,150,582 | A * | 9/1992 | Gotou | F25B 13/00 62/155 |
| 2004/0035135 | A1 * | 2/2004 | Park | F25B 13/00 62/324.6 |
| 2010/0003467 | A1 * | 1/2010 | Moronuki | B41M 5/30 428/195.1 |

FOREIGN PATENT DOCUMENTS

| | | | |
|---|---|---|---|
| JP | 05-215437 | A | 8/1993 |
| JP | 2005-344995 | A | 12/2005 |
| WO | 2010/128557 | A1 | 11/2010 |
| WO | 2011/074028 | A1 | 6/2011 |

OTHER PUBLICATIONS

WO 2011074028 (English Translation).*
International Search Report of the International Searching Authority mailed Sep. 4, 2012 for the corresponding international application No. PCT/JP2012/003515 (and English translation).
European Extended Search Report issued on Feb. 9, 2016 in the corresponding EP application No. 12878027.7.
Office Action issued Feb. 23, 2016 in the corresponding JP application No. 2014-518080 (with English translation).
Office Action issued Jul. 14, 2015 in the corresponding JP application No. 2014-518080 (with English translation).
Office Action issued Sep. 18, 2015 in the corresponding CN application No. 201280073555.8 (with English translation).

* cited by examiner

AIR-CONDITIONING APPARATUS WITH SIMULTANEOUS HEATING AND COOLING OPERATION

CROSS REFERENCE TO RELATED APPLICATIONS

This application is a U.S. national stage application of PCT/JP2012/003515 filed on May 30, 2012, the contents of which are incorporated herein by reference.

TECHNICAL FIELD

The present invention relates to an air-conditioning apparatus that can perform operation such that each of a plurality of indoor units (load-side units) carries out a cooling operation or a heating operation (hereinafter referred to as cooling and heating mixed operation), and more particularly, to an air-conditioning apparatus that improves operation stability by suppressing degradation of the capacity during cooling and heating mixed operation in a low outside air condition.

BACKGROUND

There has hitherto been an air-conditioning apparatus capable of cooling and heating mixed operation (see, for example, Patent Literature 1). Such an air-conditioning apparatus determines, in accordance with the air condition and operation load, whether load-side units are to be operated in a cooling cycle or a heating cycle. Such an air-conditioning apparatus selects a proper refrigeration cycle in accordance with the load, and realizes the cooling and heating mixed operation.

PATENT LITERATURE

Patent Literature 1: Japanese Patent Application No. 2005-344995 (for example, Embodiment 1)

In the air-conditioning apparatus described in Patent Literature 1, when a load-side unit operates in a heating cycle during the cooling and heating mixed operation, an outdoor heat exchanger functions as an evaporator. Therefore, when the ambient temperature of a heat-source-side unit decreases, the evaporating temperature decreases along with the ambient temperature. At this time, the evaporating temperature of a load-side unit that is performing the cooling operation also decreases. When the evaporating temperature of the load-side unit decreases to 0 degrees C. or less, pipes may be deformed and broken by ice produced by freezing. Further, when frost generated on fins of a heat exchanger mounted in the load-side unit melts, it is not completely received by a drain pan, and this may cause water leakage.

To avoid such a situation, there has already been control that forcibly stops the operation of the load-side unit when the liquid pipe temperature of the load-side unit decreases to be lower than or equal to a predetermined temperature (hereinafter referred to as antifreezing control). However, when antifreezing control is executed, the load-side unit that is performing the heating operation continuously operates, whereas the load-side unit that is performing the cooling operation forcibly stops the operation, and the air-conditioning capacity thereof becomes 0 under suspension. During this time, comfort of the user is impaired. Further, since the stop and the start are repeated, the operation state becomes unstable, and the capacity cannot be exercised continuously.

SUMMARY

The present invention has been made in view of the above-described problems, and an object of the invention is to provide an air-conditioning apparatus that enhances operation stability by suppressing degradation of the capacity during cooling and heating mixed operation in a low outside air condition without executing antifreezing control.

An air-conditioning apparatus according to the present invention is capable of cooling and heating mixed operation and is configured such that at least one heat-source-side unit including a compressor and an outdoor heat exchanger is connected to a plurality of load-side units each including an expansion device and an indoor heat exchanger, the plurality of load-side units being connected to the heat-source-side unit in parallel. The air-conditioning apparatus includes an opening and closing valve mounted in the heat-source-side unit to adjust a flow of refrigerant from the load-side units to the outdoor heat exchanger, a heat-source-side expansion device mounted in the heat-source-side unit and provided in parallel with the opening and closing valve, and a controller configured to control at least opening and closing of the opening and closing valve and an opening degree of the heat-source-side expansion device. In a heating main operation mode in which a heating load is dominant in the cooling and heating mixed operation with the plurality of load-side units and under a condition where a liquid pipe temperature of the load-side unit that is performing a cooling operation is within a temperature range of antifreezing control, the controller closes the opening and closing valve and controls the opening degree of the heat-source-side expansion device according to an evaporating temperature of the load-side unit requesting cooling so as to adjust the evaporating temperature to be within a predetermined range.

According to the air-conditioning apparatus of the present invention, the liquid pipe temperature of the load-side unit can be controlled to be within a proper range with the opening degree of the heat-source-side expansion device particularly in a heating main operation mode during cooling and heating mixed operation. Hence, operation stability can be enhanced by suppressing degradation of the capacity during the cooling and heating mixed operation in a low outside side condition without executing antifreezing control.

DETAILED DESCRIPTION

Embodiment of the present invention will be described below with reference to the drawings.

Figure 1:
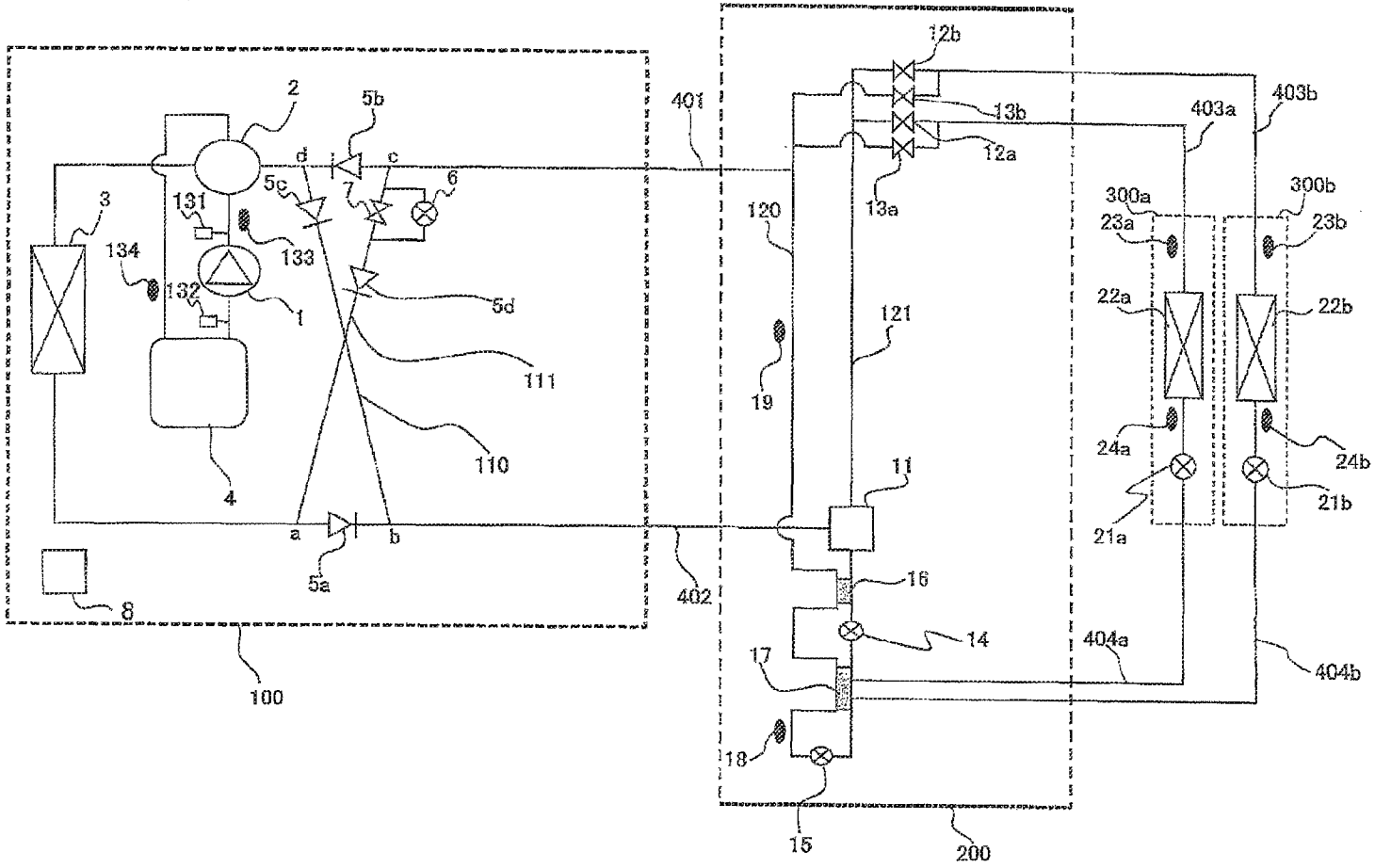
FIG. 1 is a schematic structural view illustrating an example of a refrigerant circuit configuration of an air-conditioning apparatus according to Embodiment of the present invention.

FIG. 1 is a schematic structural view illustrating an example of a refrigerant circuit configuration of an air-conditioning apparatus 500 according to Embodiment of the present invention. With reference to FIG. 1, the refrigerant circuit configuration of the air-conditioning apparatus 500 will be described. The air-conditioning apparatus 500 is installed in, for example, a building or an apartment house, and can perform the cooling and heating mixed operation utilizing a refrigeration cycle (heat pump cycle) that circulates the refrigerant. In FIG. 1 and subsequent drawings, the dimensional relationships among components are sometimes different from the actual ones.

The air-conditioning apparatus 500 includes a heat-source-side unit 100, a plurality of (two in FIG. 1) load-side units 300 (load side units 300*a*, 300*b*), and a refrigerant control unit 200. The refrigerant control unit 200 is disposed between the heat-source-side unit 100 and the load-side units 300, and carries out the cooling operation or the heating operation in each of the load-side units 300 by switching the flow of refrigerant. In the air-conditioning apparatus 500, the heat-source-side unit 100 and the refrigerant control unit 200 are connected by two pipes (high-pressure pipe 402, low-pressure pipe 401) and the refrigerant control unit 200 and the load-side units 300 are connected by two pipes (liquid pipes 404 (liquid pipes 404*a*, 404*b*) and gas pipes 403 (gas pipes 403*a*, 403*b*)), whereby a refrigeration cycle is formed.

[Heat-Source-Side Unit 100]

The heat-source-side unit 100 has a function of supplying cooling energy or heating energy to the load-side units 300.

In the heat-source-side unit 100, a compressor 1, a four-way switch valve 2 serving as flow switching means, an outdoor heat exchanger 3, and an accumulator 4 are mounted and connected in series to constitute a main refrigerant circuit. In the heat-source-side unit 100, a check valve 5*a*, a check valve 5*b*, a check valve 5*c*, a check valve 5*d*, a first connecting pipe 110, and a second connecting pipe 111 are also mounted so that the refrigerant flowing into the refrigerant control unit 200 to flow in a fixed direction, regardless of the requests from the load-side units 300. In the heat-source-side unit 100, an expansion device (heat-source-side expansion device) 6 and an opening and closing valve 7 are also mounted.

The compressor 1 sucks a low-temperature and low-pressure gas refrigerant, compresses the refrigerant into a high-temperature and high-pressure gas refrigerant, and performs an air-conditioning operation by circulating the refrigerant in the system. For example, the compressor 1 is preferably formed by a compressor of an inverter type capable of capacity control. However, the compressor 1 is not limited to the compressor of the inverter type capable of capacity control, and may be a compressor of a constant speed type or a compressor formed by a combination of an inverter type and a constant-speed type.

The four-way switch valve 2 is provided on a discharge side of the compressor 1, and switches the refrigerant passage between the cooling operation and the heating operation. The four-way switch valve 2 controls the flow of refrigerant so that the outdoor heat exchanger 3 functions as an evaporator or a condenser in accordance with an operation mode.

The outdoor heat exchanger 3 exchanges heat between a heat medium (for example, ambient air or water) and the refrigerant, functions as an evaporator to evaporate and gasify the refrigerant during heating operation, and functions as a condenser (radiator) to condense and liquefy the refrigerant during cooling operation. The outdoor heat exchanger 3 is generally provided with an unillustrated fan, and controls the condensation capacity or evaporation capacity by the rotation speed of the fan.

The accumulator 4 is provided on a suction side of the compressor 1, and has a function of storing extra refrigerant and a function of separating liquid refrigerant and gas refrigerant.

The first connecting pipe 110 connects the high-pressure pipe 402 on a downstream side of the check valve 5*a* and the low-pressure pipe 401 on a downstream side of the check valve 5*b*. The second connecting pipe 111 connects the high-pressure pipe 402 on an upstream side of the check valve 5*a* and the low-pressure pipe 401 on an upstream side of the check valve 5*b*. A confluence of the second connecting pipe 111 and the high-pressure pipe 402, a confluence of the first connecting pipe 110 and the high-pressure pipe 402, a confluence of the second connecting pipe 111 and the low-pressure pipe 401, and a confluence of the first connecting pipe 110 and the low-pressure pipe 401 are illustrated as a confluence a, a confluence b (downstream of the confluence a), a confluence c, and a confluence d (downstream of the confluence c), respectively.

The check valve 5*b* is provided between the confluence c and the confluence d, and allows the refrigerant to flow only in a direction from the refrigerant control unit 200 to the heat-source-side unit 100. The check valve 5*a* is provided between the confluence a and the confluence b, and allows the refrigerant to flow only in a direction from the heat-source-side unit 100 to the refrigerant control unit 200. The check valve 5*c* is provided to the first connecting pipe 110, and allows the refrigerant to flow only in a direction from the confluence d to the confluence b. The check valve 5*d* is provided to the second connecting pipe 111, and allows the refrigerant to flow only in a direction from the confluence c to the confluence a.

The opening and closing valve 7 is provided upstream of the outdoor heat exchanger 3 in the heat-source-side unit 100 (provided to the second connecting pipe 111 on an upstream side of the check valve 5*d* in the figure), and opening and closing thereof are controlled so as to conduct the refrigerant and so as not to conduct the refrigerant. That is, the opening and closing of the opening and closing valve 7 are controlled to adjust the flow of the refrigerant from the refrigerant control unit 200 to the outdoor heat exchanger 3.

The expansion device 6 is provided in parallel with the opening and closing valve 7, and adjusts the flow rate of refrigerant by controlling the opening degree thereof. That is, the opening degree of the expansion device 6 is controlled to adjust the load-side pipe temperature, more specifically, the evaporating temperature of indoor heat exchangers 22 (indoor heat exchangers 22*a*, 22*b*) to be within an arbitrary range.

The heat-source-side unit 100 includes at least a high-pressure sensor 131 for detecting the pressure of refrigerant discharged from the compressor 1, a low-pressure sensor 132 for detecting the pressure of the refrigerant to be sucked into the compressor 1, a discharge-temperature sensor 133 for detecting the temperature of the refrigerant discharged from the compressor 1, and an inlet-pipe temperature sensor 134 for detecting the temperature of refrigerant to flow in the accumulator 4. Information (temperature information and pressure information) detected by these various detection means is sent to a controller 8 for controlling the operation of the air-conditioning apparatus 500, and is used to control the driving frequency of the compressor 1, the rotation speed of the unillustrated fan, switching of the four-way switch valve 2, opening and closing of the opening and closing valve 7, and the opening degree of the expansion device 6.

[Refrigerant Control Unit 200]

The refrigerant control unit 200 is interposed between the heat-source-side unit 100 and the load-side units 300, and switches the flow of refrigerant in accordance with an operating situation of the load-side units 300. In FIG. 1, the letter "a" or "b" is added to the end of each of the reference numerals of some devices provided in the "refrigerant control unit 200." This letter "a" or "b" shows whether each of the devices is connected to a "load-side unit 300*a*" or a "load-side unit 300*b*" described below. In the following description, the letters "a" and "b" added to the ends of the reference numerals are sometimes omitted. In this case, it is needless to say that the description includes any device connected to the "load-side unit 300*a*" or the "load-side unit 300*b*."

The refrigerant control unit 200 is connected to the heat-source-side unit 100 by the high-pressure pipe 402 and the low-pressure pipe 401, and is connected to the load-side units 300 by the liquid pipes 404 and the gas pipes 403. In the refrigerant control unit 200, a gas-liquid separator 11, first opening and closing valves 12 (first opening and closing valves 12*a*, 12*b*), second opening and closing valves 13 (second opening and closing valves 13*a*, 13*b*), a first expansion device 14, a second expansion device 15, a first refrigerant heat exchanger 16, and a second refrigerant heat exchanger 17 are mounted. In the refrigerant control unit 200, a connecting pipe 120 is also provided. The connecting pipe 120 branches from a pipe on a downstream side of a primary side of the second refrigerant heat exchanger 17 (side where the refrigerant passing through the first expansion device 14 flows), and is connected to the low-pressure pipe 401.

The gas-liquid separator 11 is provided to the high-pressure pipe 402, and has a function of separating two-phase refrigerant flowing through the high-pressure pipe 402 into gas refrigerant and liquid refrigerant. The gas refrigerant separated by the gas-liquid separator 11 is supplied to the first opening and closing valves 12 via a connecting pipe 121, and the liquid refrigerant is supplied to the first refrigerant heat exchanger 16.

The first opening and closing valves 12 serve to control the supply of refrigerant to the load-side units 300 according to the operation mode, and are provided between the connecting pipe 121 and the gas pipes 403. That is, the first opening and closing valves 12 are connected at one side to the gas-liquid separator 11 and at the other side to the indoor heat exchangers 22 of the corresponding load-side units 300. The opening and closing of the first opening and closing valves 12 are controlled so as to conduct the refrigerant or so as not to conduct the refrigerant.

The second opening and closing valves 13 also serve to control the supply of refrigerant to the load-side units 300 according to the operation mode, and are provided between the gas pipes 403 and the low-pressure pipe 401. That is, the second opening and closing valves 13 are connected at one side to the low-pressure pipe 401 and at the other side to the indoor heat exchangers 22 of the corresponding load-side units 300. The opening and closing of the second opening and closing valves 13 are controlled so as to conduct the refrigerant or so as not to conduct the refrigerant.

The first expansion device 14 is provided to a pipe connecting the gas-liquid separator 11 and the liquid pipes 404, that is, provided between the first refrigerant heat exchanger 16 and the second refrigerant heat exchanger 17, and has a function as a pressure reducing valve and an expansion valve to expand the refrigerant by pressure reduction. The first expansion device 14 is preferably formed by a device capable of variable control of the opening degree, for example, a precise flow rate control device using an electronic expansion valve or inexpensive refrigerant flow rate adjusting means such as a capillary.

The second expansion device 15 is provided to the connecting pipe 120 and on an upstream side of a secondary side of the second refrigerant heat exchanger 17, functions as a pressure reducing valve and an expansion valve, and expands the refrigerant by pressure reduction. Similarly to the first expansion device 14, the second expansion device 15 is preferably formed by a device capable of variable control of the opening degree, for example, a precise flow rate control device using an electronic expansion valve or inexpensive refrigerant flow rate adjusting means such as a capillary.

The first refrigerant heat exchanger 16 exchanges heat between the refrigerant flowing on the primary side (side where the liquid refrigerant separated by the gas-liquid separator 11 flows) and the refrigerant flowing on a secondary side (side where the refrigerant that has flown out of the second refrigerant heat exchanger 17 flows after passing through the second expansion device 15 in the connecting pipe 120).

The second refrigerant heat exchanger 17 exchanges heat between the refrigerant flowing on a primary side (downstream side of the first expansion device 14) and the refrigerant flowing on a secondary side (downstream side of the second expansion device 15).

By mounting the first expansion device 14, the second expansion device 15, the first refrigerant heat exchanger 16, and the second refrigerant heat exchanger 17 in the refrigerant control unit 200, heat is exchanged between the refrigerant flowing in the main circuit (primary side) and the refrigerant flowing in the connecting pipe 120 (secondary side) by the first refrigerant heat exchanger 16 and the second refrigerant heat exchanger 17, so that the refrigerant flowing in the main circuit can be subcooled. By the opening degree of the second expansion device 15, the bypass amount is controlled to achieve proper subcooling at a primary side exit of the second refrigerant heat exchanger 17.

The refrigerant control unit 200 includes at least a temperature sensor 18 for detecting the temperature of the refrigerant pipe (connecting pipe 120) between the second expansion device 15 and a secondary side entrance of the second refrigerant heat exchanger 17, and a temperature sensor 19 for detecting the temperature of the connecting pipe 120 on a downstream side of the secondary side of the first refrigerant heat exchanger 16. Information (temperature information) detected by these various detection means is sent to the controller 8 for controlling the operation of the air-conditioning apparatus 500, and is used to control various actuators. That is, information from the temperature sensor 18 and the temperature sensor 19 is used to control, for example, the opening and closing of the opening and closing valves (first opening and closing valves 12, second opening and closing valves 13) and the opening degrees of the expansion devices (first expansion device 14, second expansion device 15) that are provided in the refrigerant control unit 200.

[Load-Side Units 300]

The load-side units 300 receive cooling energy or heating energy supplied from the heat-source-side unit 100 to bear a cooling load or a heating load. In FIG. 1, the letter "a" is added to the ends of the reference numerals of the devices provided in the "load-side unit 300*a*", and the letter "b" is added to the ends of the reference numerals of the devices provided in the "load-side unit 300*b*." While the letters "a" and "b" at the ends of the reference numerals are sometimes omitted in the following description, it is needless to say that both the load-side unit 300*a* and the load-side unit 300*b* include the devices.

In each load-side unit 300, an indoor heat exchanger 22 (indoor heat exchanger 22*a*, 22*b*) and an indoor expansion device 21 (indoor expansion device 21*a*, 21*b*) are mounted and connected in series. Also, an unillustrated air-sending device is preferably provided to supply air to the indoor heat exchanger 22. However, the indoor heat exchanger 22 may exchange heat between a refrigerant and a heat medium different from the refrigerant, for example, water.

The indoor heat exchanger 22 exchanges heat between a heat medium (for example, ambient air or water) and the refrigerant, functions as a condenser (radiator) to condense and liquefy the refrigerant during heating operation, and functions as an evaporator to evaporate and gasify the refrigerant during cooling operation. The indoor heat exchanger 22 is generally provided with an unillustrated fan, and the condensation capacity or evaporation capacity thereof is controlled by the rotation speed of the fan.

The indoor expansion device 21 functions as a pressure reducing valve and an expansion valve, and expands the refrigerant by pressure reduction. The indoor expansion device 21 is preferably formed by an expansion device capable of variable control of the opening degree, for example, a precise flow rate control device using an electronic expansion valve or inexpensive refrigerant flow rate adjusting means such as a capillary.

Each load-side unit 300 includes at least a temperature sensor 24 (temperature sensor 24*a*, 24*b*) for detecting the temperature of the refrigerant pipe between the indoor expansion device 21 and the indoor heat exchanger 22, and a temperature sensor 23 (temperature sensor 23*a*, 23*b*) for detecting the temperature of the refrigerant pipe between the indoor heat exchanger 22, and the first opening and closing valve 12 and the second opening and closing valve 13. Information (temperature information) detected by these various detection means is sent to the controller 8 for controlling the operation of the air-conditioning apparatus 500, and is used to control various actuators. That is, information from the temperature sensor 23 and the temperature sensor 24 is used to control, for example, the opening degree of the indoor expansion device 21 and the rotation speed of the unillustrated air-sending device that are provided in the load-side unit 300.

It is only necessary that the compressor 1 can compress sucked refrigerant into a high-pressure state, and the type of the compressor 1 is not particularly limited. For example, the compressor 1 can be formed by utilizing various types such as a reciprocating type, a rotary type, a scroll type, or a screw type. Further, the kind of the refrigerant used in the air-conditioning apparatus 500 is not particularly limited. For example, any of natural refrigerant, such as carbon dioxide, hydrocarbon, or helium, chlorine-free alternative refrigerant, such as HFC410A, HFC407C, or HFC404A, and fluorocarbon refrigerant used in existing products, such as R22 or R134a, may be used.

While the controller 8 for controlling the operation of the air-conditioning apparatus 500 is mounted in the heat-source-side unit 100 in FIG. 1, it may be provided in the refrigerant control unit 200 or any of the load-side units 300. Alternatively, the controller 8 may be provided outside the heat-source-side unit 100, the refrigerant control unit 200, and the load-side units 300. Further alternatively, the controller 8 may be divided into a plurality of controllers in correspondence with the functions, and the controllers may be provided in the heat-source-side unit 100, the refrigerant control unit 200, and the load-side units 300, respectively. In this case, the controllers are preferably connected by radio or by wire such as to be capable of communication.

The operation performed by the air-conditioning apparatus 500 will be described.

The air-conditioning apparatus 500 receives a cooling operation request or a heating operation request from, for example, a remote controller disposed inside the room, and then performs an air-conditioning operation. In correspondence with these requests, there are four operation modes. The four operation modes include a cooling only operation mode in which all the load-side units 300 receive a cooling operation request, a cooling main operation mode in which a cooling operation request and a heating operation request are mixed and it is determined that a load to be processed by the cooling operation is dominant, a heating main operation mode in which a cooling operation request and a heating operation request are mixed and it is determined that a load to be processed by the heating operation is dominant, and a heating only operation mode in which all of the load-side units 300 receive a heating operation request.

A description will be given below of a heating only operation mode and a heating main operation mode in which the evaporating temperature is decreased by the influence of the ambient temperature and the outdoor heat exchanger 3 operates as an evaporator.

[Heating Only Operation Mode]

Figure 2:
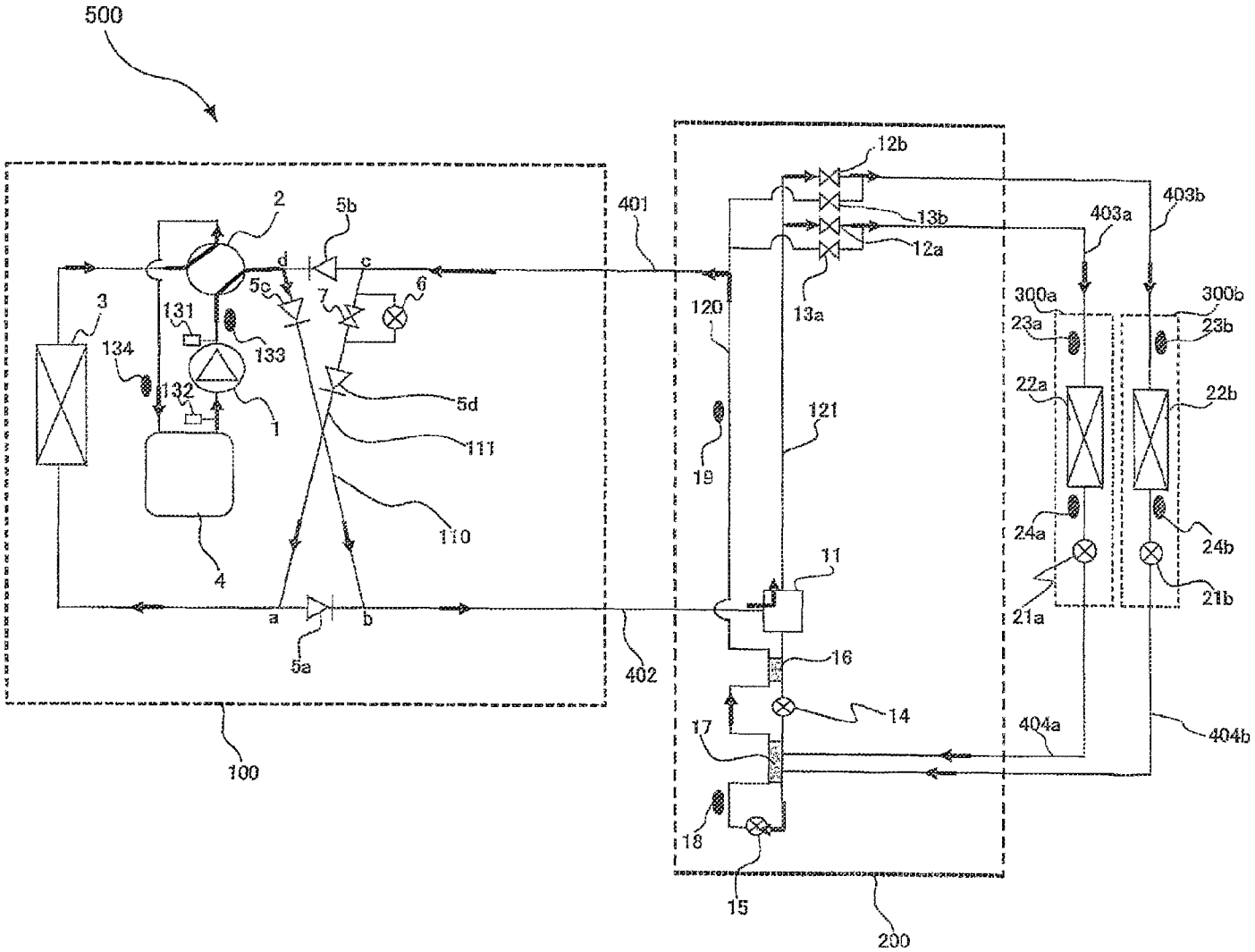
FIG. 2 is a refrigerant circuit diagram illustrating the flow of refrigerant in a heating only operation mode of the air-conditioning apparatus according to Embodiment of the present invention.

FIG. 2 is a refrigerant circuit diagram illustrating the flow of refrigerant in a heating only operation mode of the air-conditioning apparatus 500. With reference to FIG. 2, a description will be given of the operation of the air-conditioning apparatus 500 in the heating only operation mode.

A low-temperature and low-pressure refrigerant is compressed by the compressor 1, and is discharged as a high-temperature and high-pressure gas refrigerant. The high-temperature and high-pressure gas refrigerant discharged from the compressor 1 passes through the four-way switch valve 2, and flows to the high-pressure pipe 402 via the check valve 5*c*. After that, this refrigerant flows out of the heat-source-side unit 100. The high-temperature and high-pressure gas refrigerant that has flown out of the heat-source-side unit 100 passes through the gas-liquid separator 11 of the refrigerant control unit 200, and reaches the first opening and closing valves 12 through the connecting pipe 121. The first opening and closing valves 12 are opened, and the second opening and closing valves 13 are closed. The high-temperature and high-pressure gas refrigerant passes through the gas pipes 403, and reaches the load-side units 300.

The gas refrigerant that has flown in the load-side units 300 flows into the indoor heat exchangers 22 (indoor heat exchanger 22*a* and indoor heat exchanger 22*b*). Since the indoor heat exchangers 22 function as condensers, the refrigerant is condensed and liquefied by heat exchange with ambient air. At this time, the refrigerant transfers heat to the surroundings, so that an air-conditioned space, such as the inside of the room, is heated. After that, the liquid refrigerant that has flown out of the indoor heat exchangers 22 is subjected to pressure reduction in the indoor expansion devices 21 (indoor expansion device 21*a* and indoor expansion device 21*b*), and then flows out of the load-side units 300.

The liquid refrigerant, whose pressure has been reduced in the indoor expansion devices 21, flows through the liquid pipes 404 (liquid pipe 404*a* and liquid pipe 404*b*), and flows into the refrigerant control unit 200. The liquid refrigerant that has flown in the refrigerant control unit 200 passes through the second expansion device 15, and reaches the low-pressure pipe 401 through the connecting pipe 120. After flowing out of the refrigerant control unit 200, the refrigerant flowing through the low-pressure pipe 401 returns to the heat-source-side unit 100.

In the heating only operation mode, the opening and closing valve 7 is open and the expansion device 6 is closed. The refrigerant returned to the heat-source-side unit 100 reaches the outdoor heat exchanger 3 via the opening and closing valve 7 and the check valve 5*d*. Since the outdoor heat exchanger 3 functions as an evaporator, the refrigerant is evaporated and gasified by heat exchange with ambient air. After that, the refrigerant flows out of the outdoor heat exchanger 3, and flows into the accumulator 4 via the four-way switch valve 2. Then, the refrigerant in the accumulator 4 is sucked by the compressor 1, and is circulated in the system, so that the refrigeration cycle is established. Through the above procedure, the air-conditioning apparatus 500 carries out the heating only operation mode.

When a cooling operation request and a heating operation request are mixed as operation requests given to the air-conditioning apparatus 500 and it is determined that the load to be processed by the heating operation is dominant, a heating main operation mode is executed as an operation mode.

[Heating Main Operation Mode]

Figure 3:
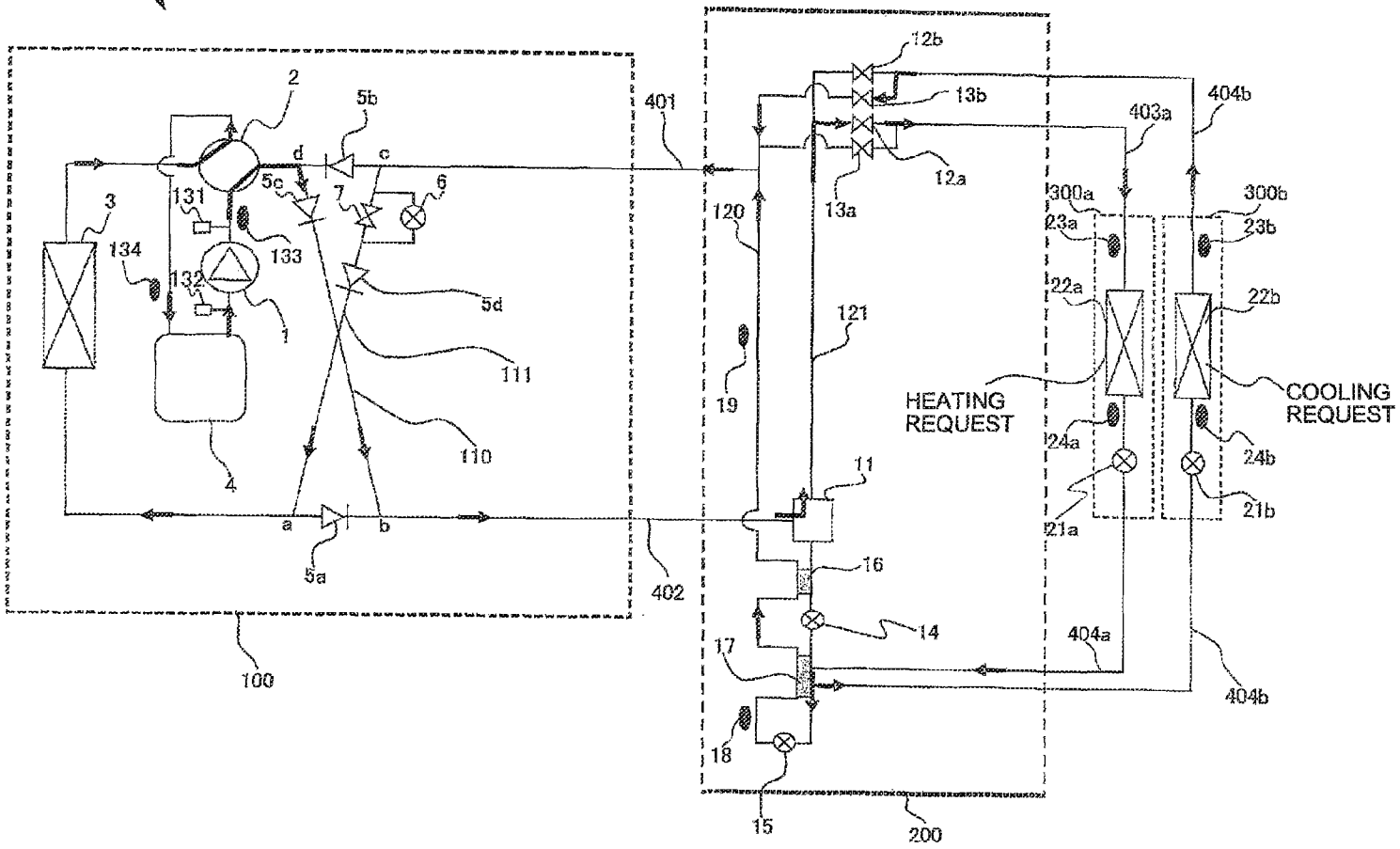
FIG. 3 is a refrigerant circuit diagram illustrating the flow of refrigerant in a heating main operation mode of the air-conditioning apparatus according to Embodiment of the present invention.

FIG. 3 is a refrigerant circuit diagram illustrating the flow of refrigerant in a heating main operation mode of the air-conditioning apparatus 500. With reference to FIG. 3, a description will be given of the operation of the air-conditioning apparatus 500 in the heating main operation mode. Here, a description will be given of a heating main operation mode to be performed when a heating request and a cooling request are given from the load-side unit 300*a* and the load-side unit 300*b*, respectively. The flow of refrigerant to the load-side unit 300*a* requesting heating is the same as that in the heating only operation mode, and therefore, a description thereof is omitted.

Liquid refrigerant passing through the liquid pipe 404*a* is subcooled by the second refrigerant heat exchanger 17, flows through the liquid pipe 404*b*, and reaches the load-side unit 300*b* requesting cooling. The refrigerant that has flown in the load-side unit 300*b* is subjected to pressure reduction in the indoor expansion device 21*b*. The refrigerant whose pressure has been reduced by the indoor expansion device 21*b* flows into the indoor heat exchanger 22*b*. Since the indoor heat exchanger 22*b* functions as an evaporator, the refrigerant is evaporated and gasified by heat exchange with ambient air. At this time, the refrigerant removes heat from the surroundings, so that the inside of the room is cooled. After that, the refrigerant that has flown out of the load-side unit 300*b* flows through the connecting pipe 120 via the second opening and closing valve 13*b*. This flow of refrigerant joins the refrigerant that has flown through the connecting pipe 120 via the first expansion device 14 and the second expansion device 15 to be subcooled by the second refrigerant heat exchanger 17, and reaches the low-pressure pipe 401.

In the heating main operation mode, the opening and closing valve 7 is open and the expansion device 6 is closed. In this case, the refrigerant, which has flown out of the refrigerant control unit 200 and has flown in the heat-source-side unit 100, flows into the outdoor heat exchanger 3 via the opening and closing valve 7 and the check valve 5*d*. Since the outdoor heat exchanger 3 functions as an evaporator, the refrigerant is evaporated and gasified by heat exchange with ambient air. After that, the refrigerant flows into the accumulator 4 via the four-way switch valve 2. The refrigerant in the accumulator 4 is sucked by the compressor 1, and is circulated in the system, so that the refrigeration cycle is established. Through the above procedure, the air-conditioning apparatus 500 carries out the heating main operation mode.

At this time, the evaporating temperature is influenced by the ambient temperature of the indoor heat exchanger 22, and the evaporating temperature is lower than the ambient temperature because evaporation and gasification are performed at the ambient temperature. For example, when the ambient temperature is −5 degrees C., the evaporating temperature is a value lower than −5 degrees C., for example, about −11 degrees C. If there is no expansion circuit in the passage from the indoor heat exchanger 22 to the outdoor heat exchanger 3 and it is assumed for explanation that the pipe length is sufficiently short and the pressure loss due to the first opening and closing valve 12 and the second opening and closing valve 13 is negligible, the evaporating temperature of the indoor heat exchanger 22 is equal to the evaporating temperature of the outdoor heat exchanger 3. That is, the evaporating temperature of the indoor heat exchanger 22 decreases as the outside air temperature decreases, and therefore, antifreezing control is executed.

Accordingly, a description will be next given of the evaporating temperature control of the indoor heat exchanger 22 executed by the air-conditioning apparatus 500 using the expansion device 6.

In the heating main operation mode and under a condition where the liquid pipe temperature of the load-side unit 300, which is performing the cooling operation, is within a temperature range of antifreezing control, the opening and closing valve 7 is closed and the expansion device 6 is opened. While the expansion device 6 is preferably formed by a linear expansion valve serving as a variable expansion device, as described above, it may be formed by a combination of a solenoid valve and a capillary, or a combination of opening and closing valves. It is only necessary that the expansion device 6 should be a mechanism that can adjust the expansion amount. The controller 8 detects the evaporating temperature of the indoor heat exchanger 22*b* with the temperature sensor 24, and adjusts the expansion amount of the expansion device 6 so that the evaporating temperature does not decrease into the antifreezing range.

At this time, when one load-side unit 300 requests cooling, the evaporating temperature can be directly detected with the temperature sensor 24. In general, however, a plurality of load-side units 300 often request cooling. Accordingly, the temperature sensor 18 of the refrigerant control unit 200 detects a representative value of the evaporation temperatures of the load-side units 300. The temperature sensor 18 does not always need to be located between the second expansion device 15 and the second refrigerant heat exchanger 17, and it is only necessary that the temperature sensor 18 should be located in the connecting pipe 120 through which the flows of refrigerant from the load-side units 300 join and reach the low-pressure pipe 401. Instead of the expansion amount control of the expansion device 6 by temperature, the expansion amount can be adjusted by pressure detection with a pressure sensor provided to the connecting pipe 120.

Figure 4:
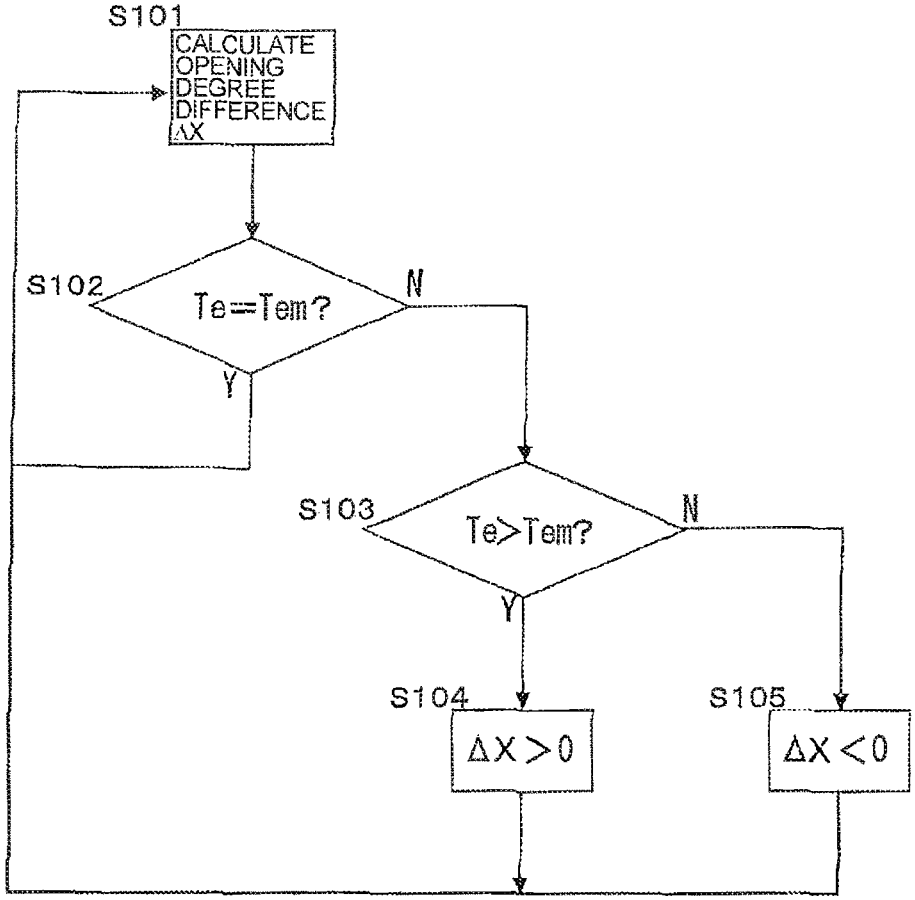
FIG. 4 is a flowchart showing the flow of control processing in a heating main operation mode in which a heating load is dominant during cooling and heating mixed operation carried out with a plurality of load-side units in the air-conditioning apparatus according to Embodiment of the present invention.

FIG. 4 is a flowchart showing the flow of control processing in a heating main operation mode, in which heating load is dominant, during cooling and heating mixed operation with a plurality of load-side units 300 executed in the air-conditioning apparatus 500. With reference to FIG. 4, a description will be given of an exemplary control of the opening and closing valve 7 and the expansion device 6 in the heating main operation mode and under the condition where the liquid pipe temperature of the load-side unit 300, which is performing the cooling operation, is within the temperature range of antifreezing control. At this time, the controller 8 performs control to close the opening and closing valve 7.

In the heating main operation mode in which the heating load is dominant during the cooling and heating mixed operation using a plurality of load-side units 300, the controller 8 calculates a change amount (opening degree difference) ΔX (Step S101). The change amount ΔX is found as the change amount (opening degree difference) relative to an opening degree X of the expansion device 6 from a saturation temperature Te0 calculated from the low-pressure sensor 132, a detection temperature Te of the temperature sensor 19, and a target temperature Tem of the temperature sensor 19. It is only necessary for the opening degree X of the expansion device 6 to be controlled so that the indoor heat exchangers 22 of the load-side units 300 do not freeze, and the target temperature Tem should be determined in consideration of the influence of pressure loss in the refrigerant control unit 200, the low-pressure pipe 401, and the gas pipes 403. When the pressure loss in the refrigerant control unit 200, the low-pressure pipe 401, and the gas pipes 403 is sufficiently small, Tem can be higher than or equal to the freezing temperature of the pipes (=0 degrees C.), for example, can be equal to 1.

When Te is not equal to Tem (Step S102; N), the controller 8 compares Te and Tem (Step S103). When Te is higher than Tem (Step S103; Y), the controller 8 makes ΔX more than 0 because there is a need to increase the opening degree of the expansion device 6 to increase the pressure difference (Step S104). Conversely, when Te is lower than Tem (Step S103; N), the controller 8 decreases the pressure difference by decreasing the opening degree of the expansion device 6 so that ΔX<0 (Step S105). At this time, for calculation of ΔX, it is conceivable to perform control to open the expansion device 6 at the opening degree corresponding to the temperature difference (Tem-Te) from the target temperature Tem.

As described above, in the air-conditioning apparatus 500, the opening degree of the expansion device 6 is properly controlled so that the temperatures of the load-side units 300 are not within the protective range particularly during the cooling and heating mixed operation. Hence, it is possible to avoid antifreezing control, to suppress degradation of the capacity during the cooling and heating mixed operation in a low outside air condition, and to enhance operation stability.

While one heat-source-side unit 100, one refrigerant control unit 200, and two load-side units 300 are provided in Embodiment, the number of units is not particularly limited. Further, while the present invention is applied to the air-conditioning apparatus 500 in Embodiment, it can also be applied to other systems, including a refrigeration system, which forms a refrigerant circuit using a refrigeration cycle. While the opening and closing valve 7 and the expansion device 6 are preferably connected to the illustrated positions to reduce the pressure loss during cooling operation, they may be provided to the low-pressure pipe 401 on the upstream side of the confluence c (see FIGS. 5 and 6).

[Cooling Only Operation Mode]

Figure 5:
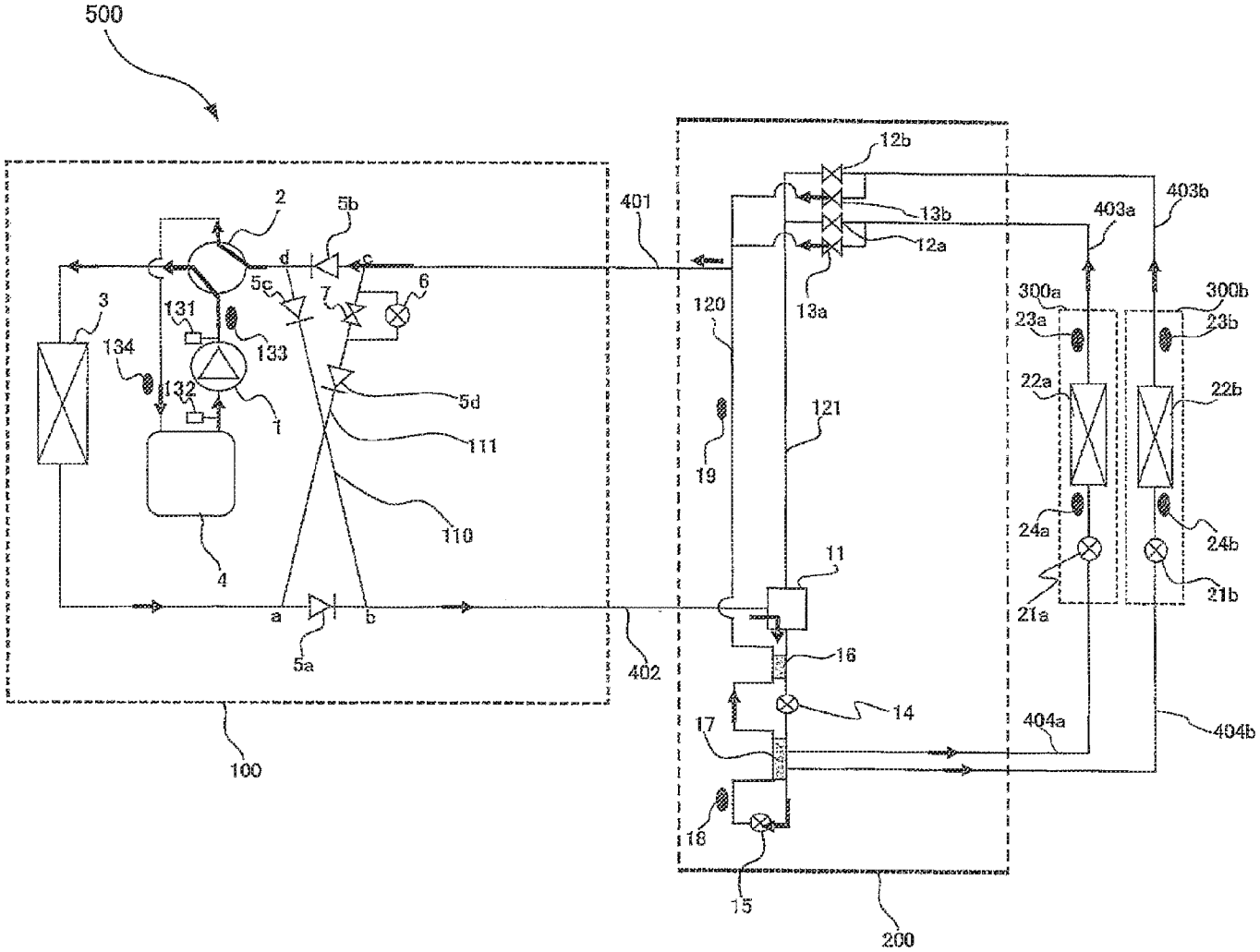
FIG. 5 is a refrigerant circuit diagram illustrating the flow of refrigerant in a cooling only operation mode of the air-conditioning apparatus according to Embodiment of the present invention.

FIG. 5 is a refrigerant circuit diagram illustrating the flow of refrigerant in a cooling only operation mode of the air-conditioning apparatus 500. With reference to FIG. 5, a brief description will be given of the operation of the air-conditioning apparatus 500 in the cooling only operation mode.

A low-temperature and low-pressure refrigerant is compressed by the compressor 1, and is discharged as a high-temperature and high-pressure gas refrigerant. The high-temperature and high-pressure gas refrigerant discharged from the compressor 1 passes through the four-way switch valve 2, and flows to the outdoor heat exchanger 3. Since the outdoor heat exchanger 3 functions as a condenser, the refrigerant is condensed and liquefied by heat exchange with ambient air. After that, the liquid refrigerant that has flown out of the outdoor heat exchanger 3 passes through the high-pressure pipe 402, and flows out of the heat-source-side unit 100 via the check valve 5*a*.

The high-pressure liquid refrigerant that has flown out of the heat-source-side unit 100 passes through the gas-liquid separator 11 of the refrigerant control unit 200, and flows into the primary side of the first refrigerant heat exchanger 16. The liquid refrigerant that has flown in the primary side of the first refrigerant heat exchanger 16 is subcooled by the refrigerant on the secondary side of the first refrigerant heat exchanger 16. The liquid refrigerant with the increased degree of subcooling is expanded to an intermediate pressure by the first expansion device 14. After that, this liquid refrigerant flows to the second refrigerant heat exchanger 17, and the degree of subcooling thereof is increased further. Then, the liquid refrigerant diverges, and a part thereof flows through the liquid pipes 404*a* and 404*b* and flows out of the refrigerant control unit 200.

The liquid refrigerant that has flown out of the refrigerant control unit 200 flows into the load-side units 300*a* and 300*b*. The liquid refrigerant that has flown in the load-side units 300*a* and 300*b* is expanded by the indoor expansion devices 21*a* and 21*b* into a low-temperature two-phase gas-liquid refrigerant. This low-temperature two-phase gas-liquid refrigerant flows into the indoor heat exchangers 22*a* and 22*b*. Since the indoor heat exchangers 22*a* and 22*b* function as evaporators, the refrigerant is evaporated and gasified by heat exchange with ambient air. At this time, the refrigerant removes heat from the surroundings, and the inside of the room is thereby cooled. After that, the refrigerant that has flown out of the load-side units 300*a* and 300*b* passes through the second opening and closing valves 13*a* and 13*b*, joins the refrigerant that has flown through the connecting pipe 120 via the first expansion device 14 and the second expansion device 15 to be subcooled in the second refrigerant heat exchanger 17, and reaches the low-pressure pipe 401.

After flowing out of the refrigerant control unit 200, the refrigerant flowing in the low-pressure pipe 401 returns to the heat-source-side unit 100. The gas refrigerant returned to the heat-source-side unit 100 is sucked by the compressor 1 again via the check valve 5*b*, the four-way switch valve 2, and the accumulator 4. Through the above procedure, the air-conditioning apparatus 500 carries out the cooling only operation mode. That is, the circuit is configured such that the refrigerant does not flow in the second connecting pipe 111 during the cooling only operation. This shows that the opening and closing valve 7 and the expansion device 6 are preferably provided to the second connecting pipe 111.

[Cooling Main Operation Mode]

Figure 6:
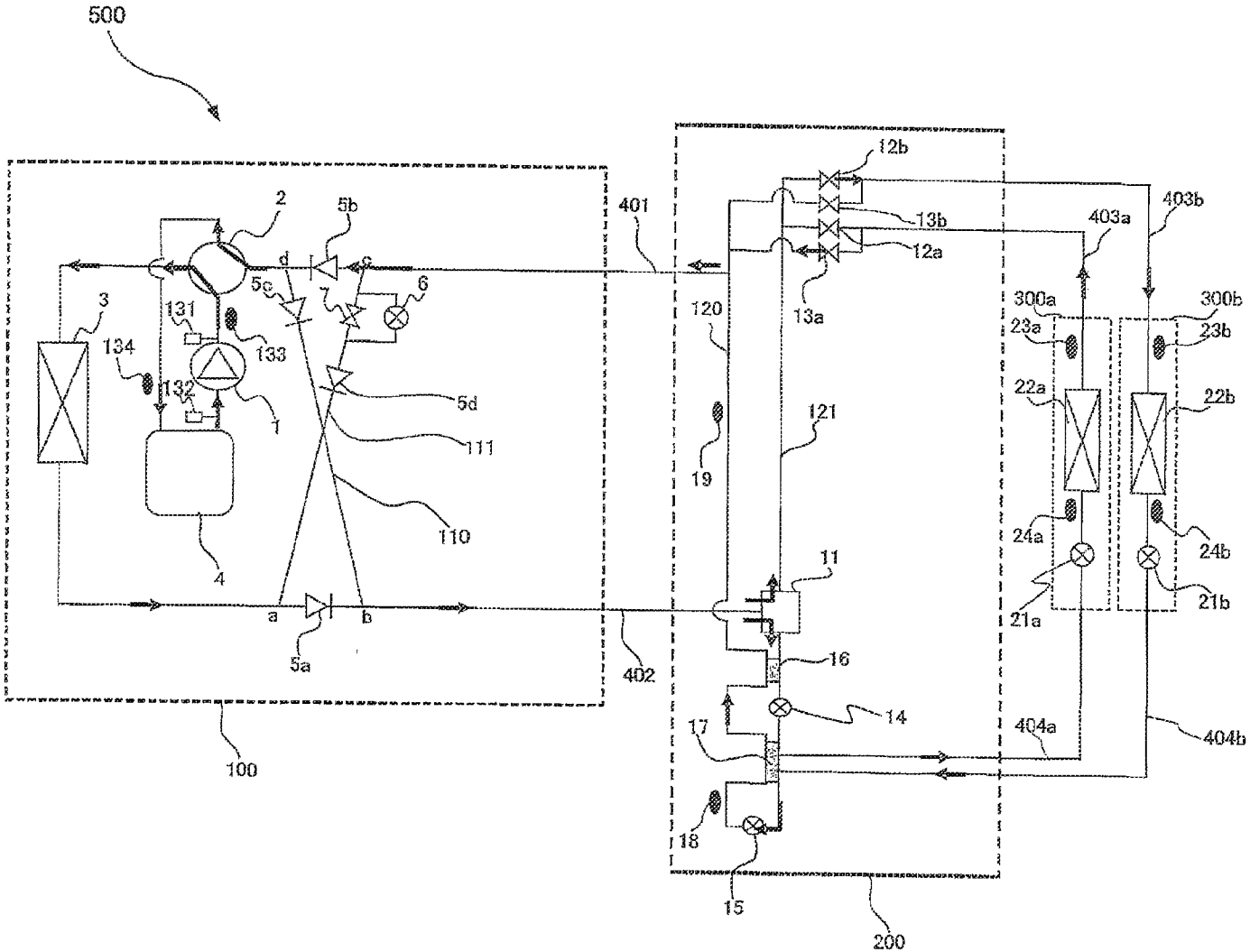
FIG. 6 is a refrigerant circuit diagram illustrating the flow of refrigerant in a cooling main operation mode of the air-conditioning apparatus according to Embodiment of the present invention.

FIG. 6 is a refrigerant circuit diagram illustrating the flow of refrigerant in a cooling main operation mode of the air-conditioning apparatus 500. With reference to FIG. 6, a description will be given of the operation of the air-conditioning apparatus 500 in the cooling main operation mode. Here, a description will be given of a cooling main operation mode when a cooling request and a heating request are given from the load-side unit 300*a* and the load-side unit 300*b*, respectively.

A low-temperature and low-pressure refrigerant is compressed by the compressor 1, and is discharged as a high-temperature and high-pressure gas refrigerant. The high-temperature and high-pressure gas refrigerant discharged from the compressor 1 flows into the outdoor heat exchanger 3 via the four-way switch valve 2. Since the outdoor heat exchanger 3 functions as a condenser, the refrigerant is condensed and turned into a two-phase state by heat exchange with ambient air. After that, the two-phase gas-liquid refrigerant that has flown out of the outdoor heat exchanger 3 passes through the high-pressure pipe 402, and flows out of the heat-source-side unit 100 via the check valve 5*a*.

The two-phase gas-liquid refrigerant that has flown out of the heat-source-side unit 100 flows into the gas-liquid separator 11 of the refrigerant control unit 200. The two-phase gas-liquid refrigerant that has flown in the gas-liquid separator 11 is separated into a gas refrigerant and a liquid refrigerant by the gas-liquid separator 11. The gas refrigerant flows out of the gas-liquid separator 11, and then flows into the connecting pipe 121. The gas refrigerant that has flown in the connecting pipe 121 flows through the gas pipe 403*b* via the first opening and closing valve 12*b*, and flows into the load-side unit 300*b*. The gas refrigerant that has flown in the load-side unit 300*b* heats the air-conditioned space by transferring heat to the surroundings in the indoor heat exchanger 22*b*. The gas refrigerant itself condenses and liquefies, and flows out of the indoor heat exchanger 22*b*. The liquid refrigerant that has flown out of the indoor heat exchanger 22*b* is expanded to an intermediate pressure by the indoor expansion device 21*b*.

The liquid refrigerant with the intermediate pressure, which has been expanded by the indoor expansion device 21*b*, flows through the liquid pipe 404*b*, joins the liquid refrigerant, which has been separated by the gas-liquid separator 11 and has flown via the first refrigerant heat exchanger 16 and the first expansion device 14, and then flows into the second refrigerant heat exchanger 17. The liquid refrigerant that has flown in the second refrigerant heat exchanger 17 further increases the degree of subcooling, flows through the liquid pipe 404*a*, and flows out of the refrigerant control unit 200. The liquid refrigerant that has flown out of the refrigerant control unit 200 flows into the load-side unit 300*a*. The liquid refrigerant that has flown in the load-side unit 300*a* is expanded by the indoor expansion device 21*a* and is turned into a low-temperature two-phase gas-liquid refrigerant. This low-temperature two-phase gas-liquid refrigerant flows into the indoor heat exchanger 22*a*, and removes heat from the surroundings to cool the air-conditioned space. The low-temperature two-phase gas-liquid refrigerant itself evaporates and gasifies, and flows out of the indoor heat exchanger 22*a*.

The gas refrigerant that has flown out of the indoor heat exchanger 22*a* flows through the gas pipe 403*a*, flows out of the load-side unit 300*a*, and then flows into the refrigerant control unit 200. The refrigerant that has flown in the refrigerant control unit 200 passes through the second opening and closing valve 13*a*, joins the refrigerant, which has flown through the connecting pipe 120 via the first expansion device 14 and the second expansion device 15 to be subcooled by the second refrigerant heat exchanger 17, and then reaches the low-pressure pipe 401.

The refrigerant flowing through the low-pressure pipe 401 flows out of the refrigerant control unit 200, and then returns to the heat-source-side unit 100. The gas refrigerant returned to the heat-source-side unit 100 is sucked by the compressor 1 again via the check valve 5*b*, the four-way switch valve 2, and the accumulator 4. Through the above procedure, the air-conditioning apparatus 500 carries out the cooling main operation mode. That is, the circuit is configured such that the refrigerant does not flow in the second connecting pipe 111 during the cooling main operation. This shows that the opening and closing valve 7 and the expansion device 6 should be preferably provided to the second connecting pipe 111.

The invention claimed is:

1. An air-conditioning apparatus capable of cooling and heating mixed operation, comprising:

at least one heat-source-side unit including a compressor and an outdoor heat exchanger and that is connected to a plurality of load-side units each including an expansion device and an indoor heat exchanger, the plurality of load-side units being connected to the heat-source-side unit in parallel;

an opening and closing valve mounted in the heat-source-side unit and connected to a pipe in which a refrigerant flows when the outdoor heat exchanger functions as an evaporator and does not flow when the outdoor heat exchanger functions as a condenser to adjust a flow of the refrigerant from the load-side units to the outdoor heat exchanger;

a heat-source-side expansion device mounted in the heat-source-side unit and provided in parallel with the opening and closing valve; and a controller configured to control at least opening and closing of the opening and closing valve and an opening degree of the heat-source-side expansion device, wherein the controller, in an operation in which the outdoor heat exchanger functions as the evaporator, in a heating main operation mode in which a heating load is dominant in the cooling and heating mixed operation with the plurality of load-side units and under a condition where a liquid pipe temperature of the load-side unit that is performing a cooling operation is within a temperature range of antifreezing control, closes the opening and closing valve, and controls the opening degree of the heat-source-side expansion device according to an evaporating temperature of the load-side unit requesting cooling so as to adjust the evaporating temperature to be within a predetermined range.

2. The air-conditioning apparatus of claim 1, wherein the controller determines the opening degree of the heat-source-side expansion device by using at least one of a temperature and a pressure of a refrigerant joined after flowing out of each of the load-side units.

3. The air-conditioning apparatus of claim 1, wherein a refrigerant control unit configured to switch a flow of the refrigerant in accordance with operating states of the load-side units is interposed between the heat-source-side unit and the load-side units.

4. The air-conditioning apparatus of claim 1, wherein the heat-source-side unit further comprises a plurality of pipes that connect a high-pressure pipe through which the refrigerant flows out and a low-pressure pipe through which the refrigerant flows in, and that allows the refrigerant flowing through the high-pressure pipe and the low-pressure pipe to flow in a fixed direction, and the pipe to which the opening and closing valve is connected to is one of the plurality of pipes.

5. The air-conditioning apparatus of claim 1, wherein the heat-source-side unit further comprises a low-pressure pipe fluidly connected between the four-way valve of the heat-source-side unit and the plurality of load-side units, a high-pressure pipe fluidly connected between the outdoor heat exchanger of the heat-source-side unit and the plurality of load-side units, a first connecting pipe that fluidly connects the low-pressure pipe to the high-pressure pipe and that includes a first check valve that permits flow towards the high-pressure pipe, a second connecting pipe that fluidly connects the low-pressure pipe to the high pressure pipe and that includes a second check valve that permits flow towards the high-pressure pipe, wherein the low-pressure pipe includes a third check valve that permits flow towards the four-way valve of the heat-source-side unit, the high-pressure pipe includes a fourth check valve that permits flow towards the plurality of load-side units, and the opening and closing valve is serially connected to the second connecting pipe.

6. The air-conditioning apparatus of claim 5, wherein the third check valve of the low-pressure pipe is located between the first connecting pipe and the second connecting pipe, and the fourth check valve of the high-pressure pipe is located between the first connecting pipe and the second connecting pipe.

* * * * *